US008578518B1

(12) United States Patent
Pflug

(10) Patent No.: US 8,578,518 B1
(45) Date of Patent: Nov. 12, 2013

(54) STAY TUCK SHIRT

(75) Inventor: Stuart I. Pflug, Atlanta, GA (US)

(73) Assignee: Manmade Concepts, LLC, Atlanta, GA (US)

( * ) Notice: Subject to any disclaimer, the term of this patent is extended or adjusted under 35 U.S.C. 154(b) by 225 days.

(21) Appl. No.: 13/091,091

(22) Filed: Apr. 20, 2011

(51) Int. Cl.
*A41B 1/00* (2006.01)

(52) U.S. Cl.
USPC ..... 2/117

(58) Field of Classification Search
USPC ..... 2/69, 115, 117, 119, 120, 229, 230, 2/329, 248
See application file for complete search history.

(56) References Cited

U.S. PATENT DOCUMENTS

| | | | | |
|---|---|---|---|---|
| 2,095,886 | A | 10/1937 | Neuman | |
| 2,129,577 | A * | 9/1938 | Guerin | 2/117 |
| 2,140,406 | A | 12/1938 | Winston | |
| 2,308,337 | A | 1/1943 | McDonald | |
| 2,308,339 | A | 1/1943 | Neuman | |
| 2,310,103 | A | 2/1943 | McDonald | |
| 2,604,626 | A * | 7/1952 | King | 2/111 |
| 2,750,595 | A | 6/1956 | Hollinger | |
| 3,281,863 | A | 11/1966 | Beard et al. | |
| D244,321 | S | 5/1977 | Phillips | |
| D294,995 | S | 4/1988 | Colledge | |
| D306,230 | S | 2/1990 | Nigro | |
| 4,987,610 | A | 1/1991 | Hunt | |
| D474,323 | S | 5/2003 | Carter | |
| D526,763 | S | 8/2006 | Tanner et al. | |
| D575,930 | S | 9/2008 | Vacchiano | |

FOREIGN PATENT DOCUMENTS

JP 2003166102 6/2003

OTHER PUBLICATIONS

Pflug, Stuart I.; Notice of Allowance for U.S. Appl. No. 29/390,173, filed Apr. 20, 2011, mailed Feb. 29, 2012, 11 pgs.
Pflug, Stuart I.; U.S. Patent Application entitled: Shirt assigned U.S. Appl. No. 29/390,173, filed Apr. 20, 2011; 12 pages.
Pflug, Stuart I.; Issue Notification for U.S. Appl. No. 29/390,173, filed Apr. 20, 2011; mailed May 16, 2012; 1 pg.
Pflug, Stuart I.; Notice of Allowance for U.S. Appl. No. 29/390,173, filed Apr. 20, 2011, mailed Jan. 19, 2012, 8 pgs.

* cited by examiner

*Primary Examiner* — Tejash Patel
(74) *Attorney, Agent, or Firm* — Taylor English Duma, LLP

(57) ABSTRACT

A garment is disclosed including a tubular body portion having a top end and a bottom end, the garment defining a body opening proximate the bottom end, a neck opening proximate the top end, and at least two sleeve openings proximate the top end, wherein the bottom end of the tubular body portion defines a notch, the notch having a terminal edge and two opposing side edges of about equal length, wherein a linear distance separates the opposing side edges, the linear distance being substantially consistent along the about equal length thereby defining substantially parallel opposing side edges.

24 Claims, 6 Drawing Sheets

STAY TUCK SHIRT

FIELD

This disclosure relates to garments. Specifically, this disclosure relates to men's undergarments.

BACKGROUND

Men's undergarments, including undershirts, are a staple of the male wardrobe. Such garments are typically designed to be worn under other shirts, particularly under formal shirts. When used under a formal shirt, such undergarments are typically intended to be tucked into a wearer's pants beneath the formal shirt. A problem arises when undershirts are unable to stay tucked in. Through a wearer's normal movements in the course of a day, an undershirt may become untucked beneath the formal shirt causing discomfort for the wearer and potentially causing the formal shirt to become untucked as well.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Disclosed is an undergarment designed to maintain its tuck. Simply extending the length of an undershirt may address the issue of the undershirt becoming untucked. However, such a solution can present other problems. For example, the extended length of the undershirt can cause bunching in the pelvic region, where features of other clothing items—including buttons, zippers, folds, creases, pleats, clasps, hems, and stitches, among others—tend to amass. Moreover, an extended-length shirt has a tendency to roll or to creep up, as the wearer's hips are generally wider than the wearer's waist. A garment 100, as shown in T-shirt embodiments in FIGS. 1A and 1B and described herein, addresses needs of maintaining a tuck without interference or bunching in the pelvic region.

In various embodiments, the garment 100 is an undershirt or undergarment. The garment 100 includes a body portion 110 and sleeve portions 120*a,b*. The sleeve portions 120*a,b* define sleeve openings 420*a,b* (shown in FIG. 4) in the garment 100. In various embodiments, the garment 100 will not have sleeve portions 120*a,b*, as depicted by the A-shirt embodiments of FIGS. 3A and 3B, for example. The body portion 110 is generally tubular in shape.

Figure 1A:
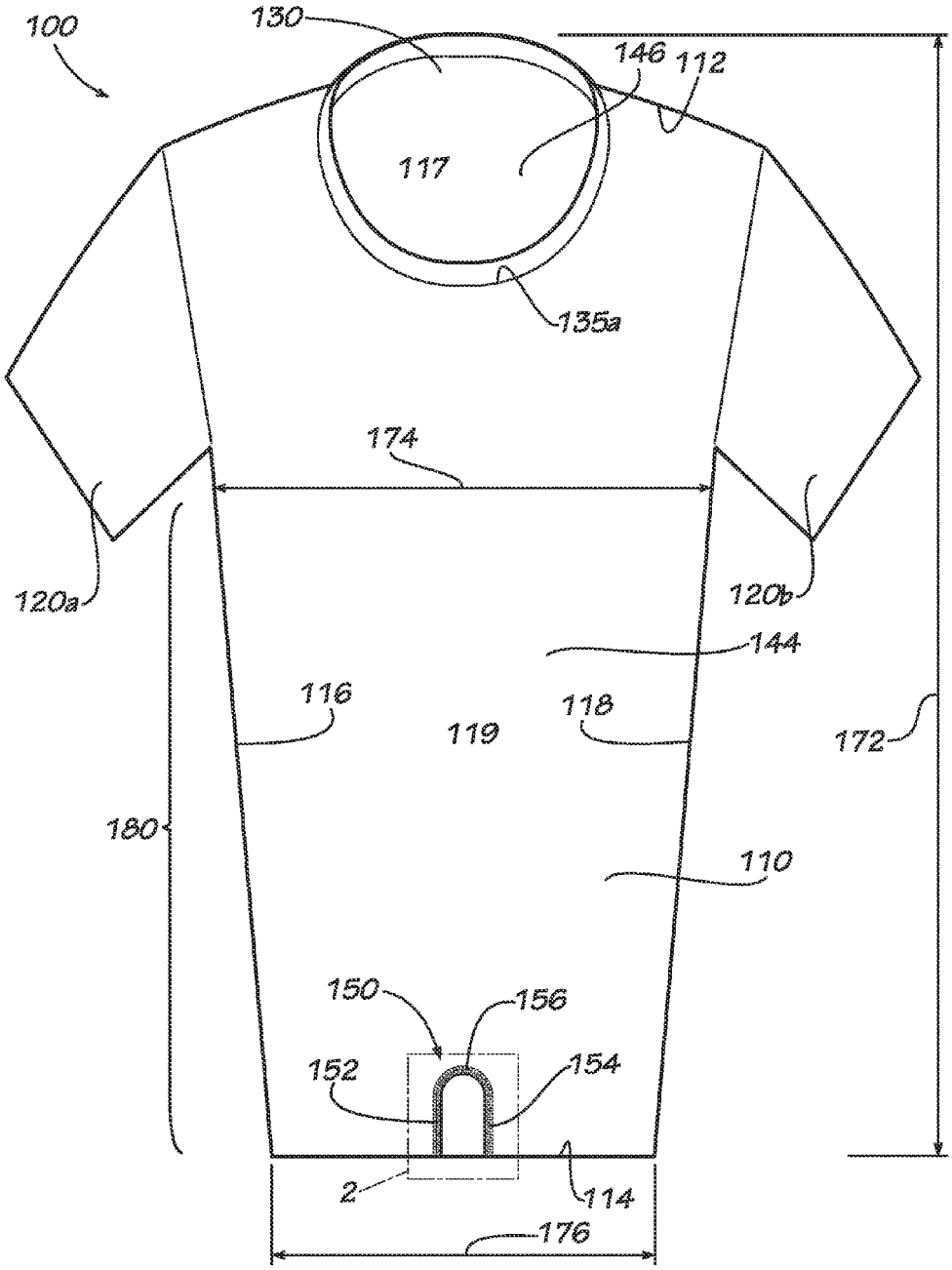
FIG. 1A is a front view of a garment in accord with one embodiment of the disclosure.
Figure 1B:
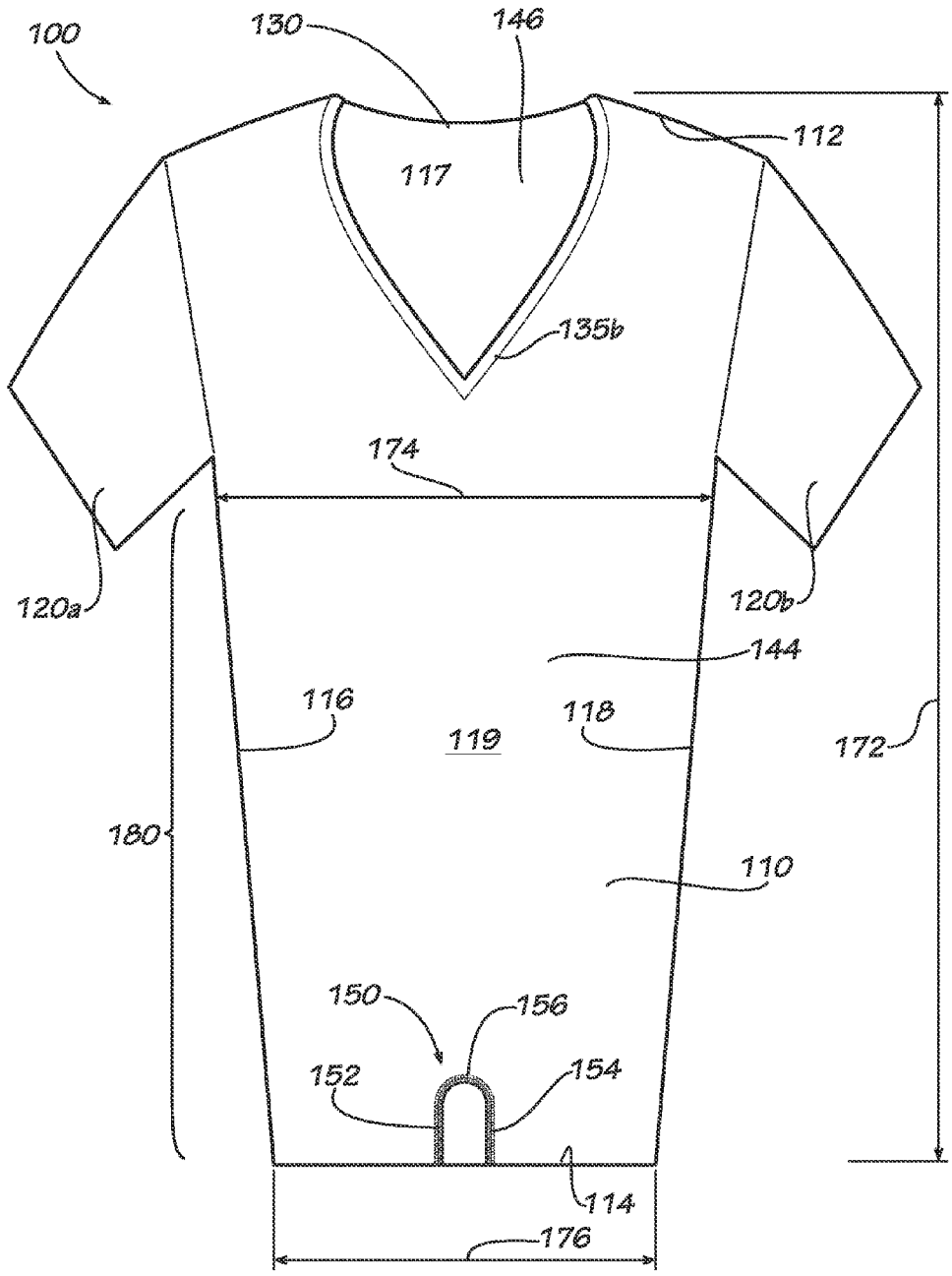
FIG. 1B is a front view of a garment in accord with one embodiment of the disclosure.

Portions of the garment 100 denoted in this disclosure may be integrally formed or may be formed of separate pieces connected together using stitching or another connection. The body portion 110 includes a top end 112, a bottom end 114, a left side end 116, and a right side end 118. Reference to "right," "left," "top," "bottom," "side," or other directional references are intended to refer to the garment 100 as oriented in FIG. 1A, unless otherwise noted. The body portion 110 also defines a neck opening 130 and a body opening 410 (shown in FIG. 4). FIGS. 1A and 1B show alternative embodiments of neck openings, including a crew neck 135*a* of FIG. 1A and a V-neck 135*b* of FIG. 1B, although other neck openings are intended to be included within this disclosure. The body opening 410 is formed at the bottom end 114 of the body portion 110. The left end 116 and right end 118 define the lateral extents of the garment 100.

In various embodiments, the neck 135*a,b* may include finish stitching. Such stitching may be serge stitched, overlock stitched, folded over and hemmed, or otherwise hemmed in various embodiments, among other configurations. In the current embodiment, the garment 100 is designed to omit product tags to promote the wearer's comfort.

In some embodiments, as depicted, the body portion 110 is formed of two separate pieces: a front portion 144 and a back portion 146. In alternative embodiments, the body portion 110 is unitary and formed of one piece, where the front portion 144 and the back portion 146 are portions of the body portion 110. In other embodiments, the body portion 110 is formed of multiple pieces. Similarly, the sleeve portions 120*a,b* may be integral or attached in various embodiments. The term "attached" as used in this disclosure includes attached by stitching. In particular, in the current embodiment, separate pieces are attached at their ends by overlock stitching, although other stitches may be used.

Typically, the garment 100 is composed of fabric, although in some embodiments other generally flexible materials may be used. In one embodiment, the garment 100 is composed of about ninety-five percent cotton and about five percent spandex fabric, wherein the spandex used is under the brand name Lycra. The range of spandex acceptable for the current embodiment is between one percent and twenty percent. The flexibility of the material as used in the current embodiment allows it to stretch as needed to allow comfortable tucking. Moreover, the composition of material allows air flow for the wearer's comfort. In alternative embodiments, other compositions or materials are applicable, including one-hundred percent cotton, polyester, nylon, modal, bamboo, and combinations of the forgoing, among others.

The dimensions of the garment 100 will vary based on sizing. No one dimension should be considered limiting on the disclosure. Dimensions provided herein are submitted by way of example only to enable one of skill in the art to make the article disclosed. The garment 100 of the current embodiment has an overall length dimension 172 that varies by size, the variation being twenty-seven inches for a small size, twenty-eight inches for a medium size, twenty-nine inches for a large size, thirty inches for an extra-large size, and thirty-one inches for an extra-extra-large size. The overall length dimension 172 may vary up to two inches greater or lesser in the current embodiment. However, other sizes and tolerances may be present in alternative embodiments.

The garment 100 includes a chest width dimension 174, wherein the chest width dimension 174 remains about the same from a region proximate the sleeve portions 120*a,b* to the top end 112 of the garment 100, the chest width dimension 174 excluding any dimension of the sleeve portions 120*a,b*. In the current embodiment, the chest width dimension 174 is sixteen inches for the small size, seventeen and one-half inches for the medium size, nineteen inches for the large size, twenty and one-half inches for the extra-large size, and twenty-two inches for the extra-extra-large size. The chest width dimension 174 may vary up to two inches greater or lesser in the current embodiment. However, other sizes and tolerances may be present in alternative embodiments.

The garment 100 includes a bottom width dimension 176. The chest width dimension 174 is greater than the bottom width dimension 176. In various embodiments, the bottom width dimension 176 may be between one and five inches smaller than the chest width dimension 174, although other bottom width dimensions 176 are possible and considered included in alternative embodiments of this disclosure. In the current embodiment, the bottom width dimension 176 is thirteen inches for the small size, fourteen and one-half inches for the medium size, sixteen inches for the large size, seventeen and one-half inches for the extra-large size, and nineteen inches for the extra-extra-large size.

Because the bottom width dimension 176 is smaller than the chest width dimension 174, the body portion 110 must narrow accordingly. In the current embodiment, the body portion 110 includes a taper region 180 wherein the body portion 110 tapers at a consistent rate. In other words, the distance between the left end 116 and the right end 118 consistently reduces in the taper region, from the chest width dimension 174 to the bottom width dimension 176. The consistent rate of taper in the taper region 180 allows the garment 100 to fit comfortably. Although not necessarily form fitting, the taper region 180 allows the garment 100 to fit more closely to the wearer's form, wherein the cotton and spandex composition of material further promotes comfort and fit.

Defined by the bottom end 114 of the body portion 110 is a notch 150 in the front portion 144. The notch 150 is centrally located in the front portion 144 such that it is in line with the neck opening 130, although other positions are considered within this disclosure. With this arrangement, the notch 150 is positioned proximate the wearer's pelvis.

The notch 150 includes a left side edge 152, a right side edge 154, and a terminal edge 156 that is rounded. The notch 150 in the current embodiment is formed orthogonally to the bottom end 114. The left side edge 152 and the right side edge 154 oppose each other in the current embodiment, being about parallel and about a consistent distance apart. The terminal edge 156 connects the left side edge 152 with the right side edge 154 by a rounded shape. Although the notch 150 having another shape is possible within this disclosure, the orthogonal and parallel configuration of the notch 150 and opposing side edges 152, 154 allows the appropriate flexibility of the garment 100 without interference in a wearer's pelvic region. Although the terminal edge 156 is rounded in the current embodiment, other shapes of terminal edge 156 are appropriate, including a gothic arch, a roman arch, pointed, or a flattened arch, so long as the opposing side edges 152, 154 are not moved substantially out of parallel.

By removing material from the wearer's pelvic region, the notch 150 prevents bunching with other clothing features amassed in that area, such as overlapped pants, overlapped underpants, zippers, buttons, clasps, hems, and stitching. Moreover, men wearing the garment 100 will appreciate added convenience when access to the pelvic region is required, as the notch 150 allows external access to the pelvic region without the need to remove one's undergarment. The parallel shape of the opposing side edges 152,154 of the notch 150 also reduces potential interference by the bottom end 114 of the garment 100 with the clothing features in the pelvic region, such as zippers, buttons, or clasps. Because the opposing side edges 152,154 of the notch 150 are a consistent distance apart, there is a low likelihood that the opposing side edges 152,154 of the notch 150 would feed into a zipper or would become tangled with a button opening or clasp, for example.

Moreover, inclusion of the notch 150 at the wearer's pelvic region allows for expansion of the garment 100 over the wearer's hips, thereby reducing the tendency of the bottom end 114 of the garment 100 to roll or to creep up the wearer's hips. In alternative embodiments, the notch 150 may be formed so that the distance between the opposing side edges 152,154 is not constant but instead is greater proximate the bottom end 114 of the garment 100 than proximate the terminal edge 156. However, under any configuration, the opposing side edges 152,154 are separated proximate the terminal edge 156 so that the notch 150 may reduce bunching in the pelvic region. If the opposing side edges 152,154 are not separated, the notch 150 may become bunched in the pelvic region. Also, the distance between the opposing side edges 152,154 does not lessen proximate the bottom end 114. If the distance between the opposing side edges 152,154 were to reduce, the angle formed by the notch 150 would allow the bottom end 114 of the garment 100 to interfere more easily with other clothing features in the pelvic region such as zippers, button holes, and clasps, among others. The garment 100 also includes an inner surface 117 and an outer surface 119.

Figure 2:
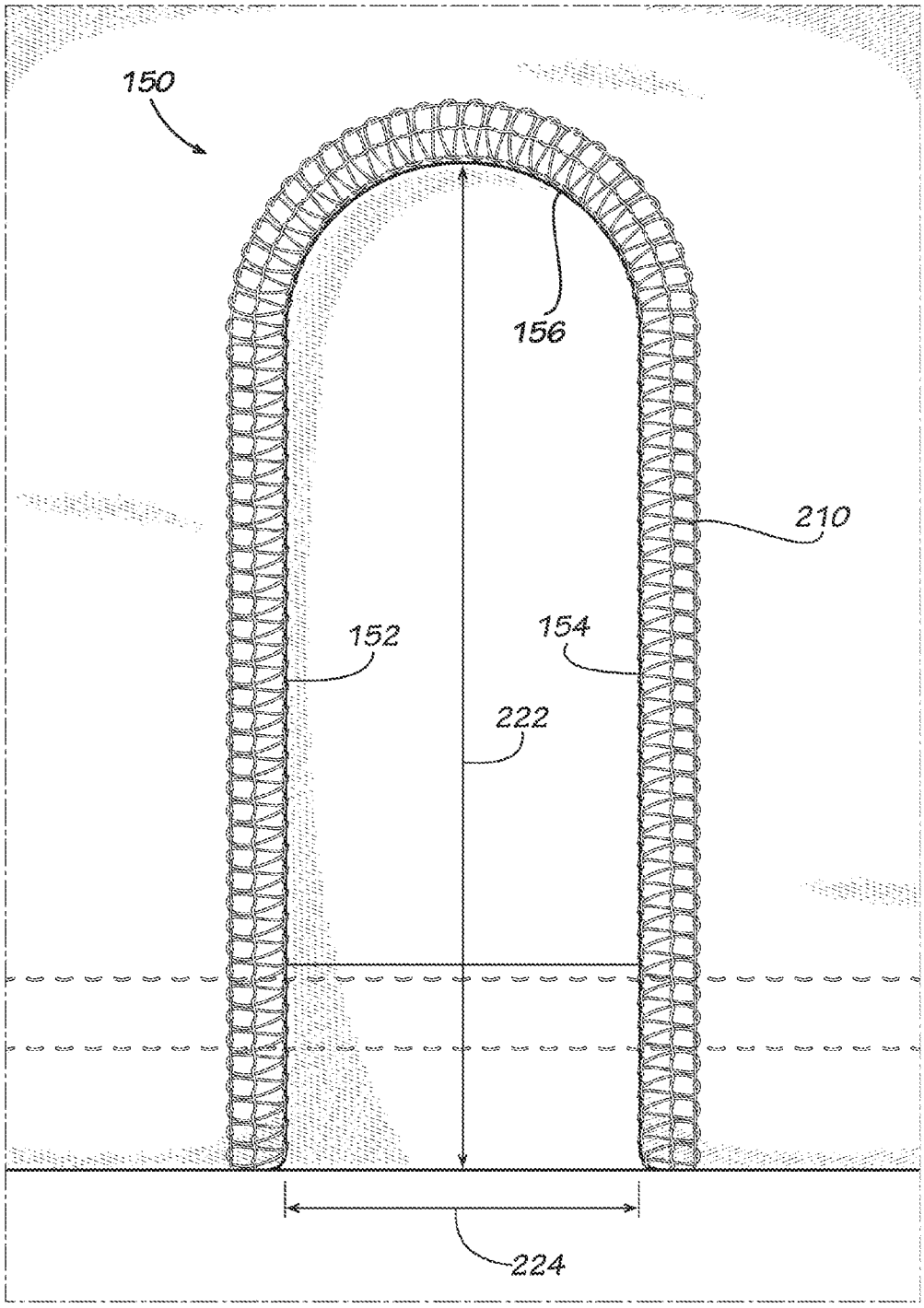
FIG. 2 is a close-up view of the notch, denoted by detail 2, of FIG. 1A.

FIG. 2 is a detail view of the notch 150. The notch 150 includes serge stitching 210 along all of its edges, including left side edge 152, right side edge 154, and terminal edge 156. Serge stitching 210 is a style of stitch that includes overlock stitching over an edge wherein the edge is cut and overlock stitching is applied over the edge to finish the cut edge. Serge stitching 210 obviates the need to fold over material with a hem to produce a finished edge. In the current embodiment, the serge stitching 210 reduces the amount of material present in the pelvic region because the notch 150 does not include a folded hem, thereby further reducing bunching and potential interference with other clothing features.

The notch 150 has linear distances defining its shape. A length dimension 222 and a width dimension 224 provide the linear distances. In the current embodiment, the notch 150 is four inches in length dimension 222 and two inches in width dimension 224. The width dimension 224 defines the linear distance between the opposing side edges 152,154, which is substantially consistent for the length of the opposing side edges 152,154. In alternative embodiments, the notch 150 may be from two to six inches in length dimension 222 and from one to five inches in width dimension 224, although other dimensions should be considered included in this disclosure.

Figure 3A:
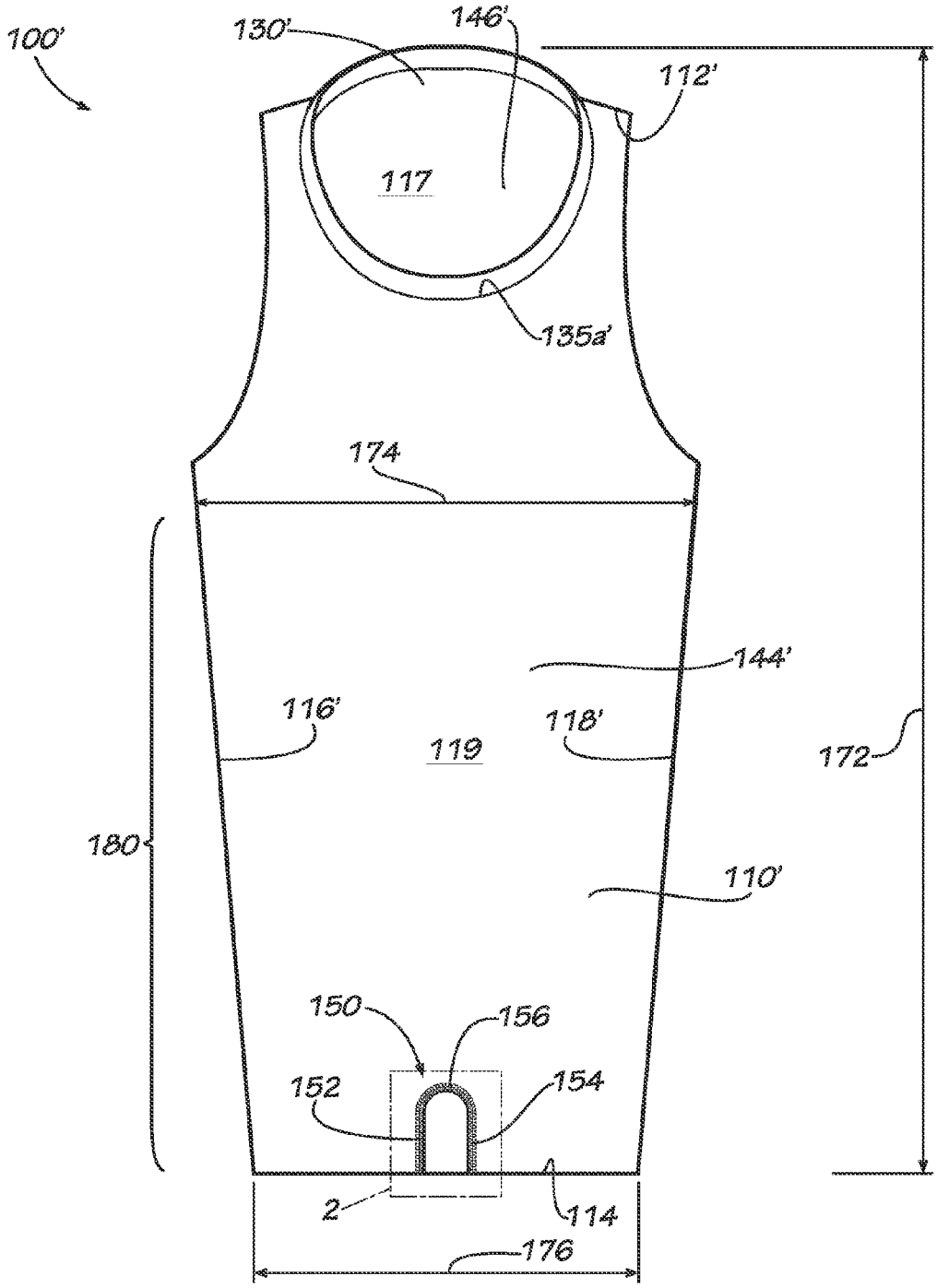
FIG. 3A is a front view of a garment in accord with one embodiment of the disclosure.
Figure 3B:
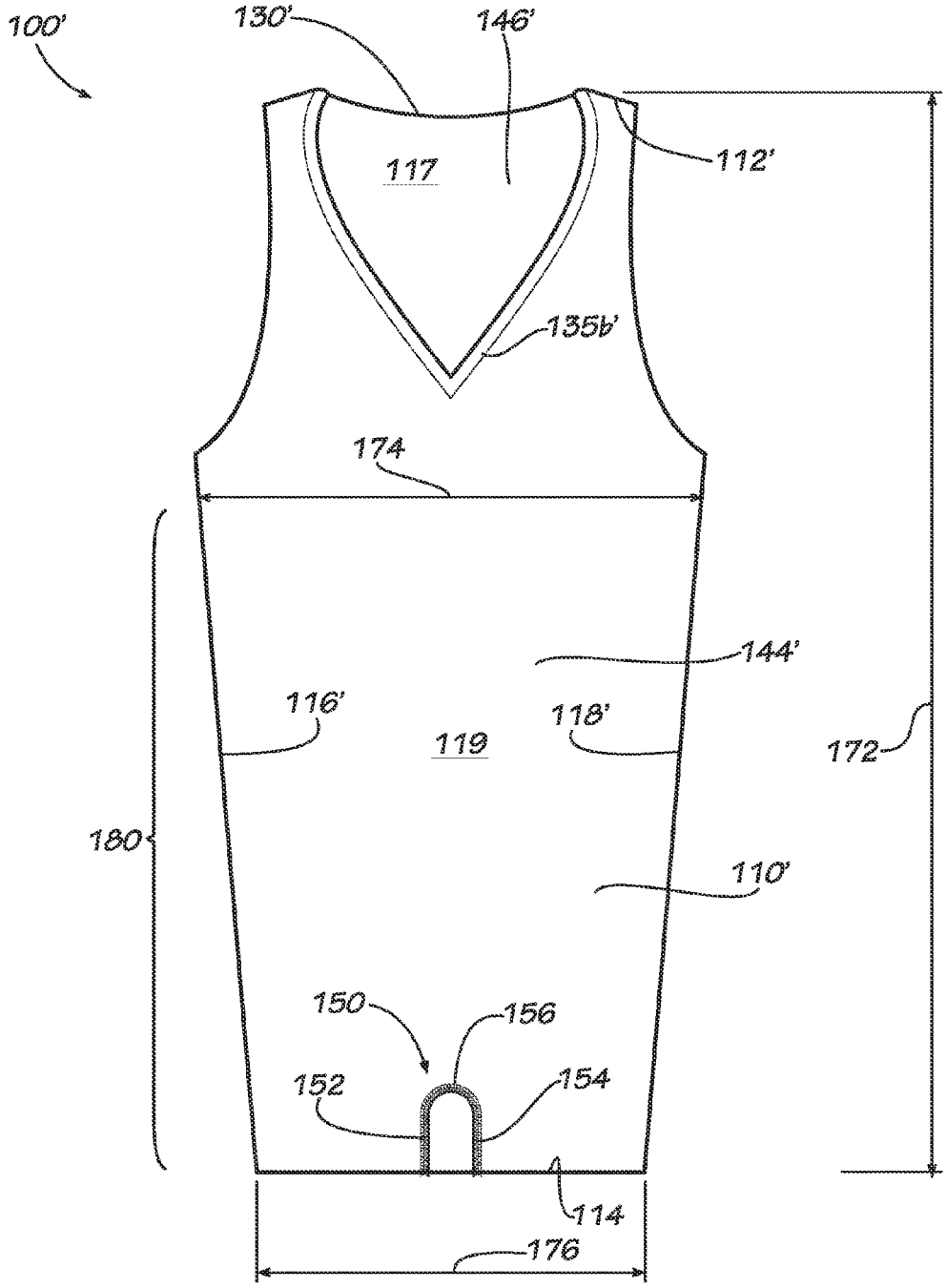
FIG. 3B is a front view of a garment in accord with one embodiment of the disclosure.

FIGS. 3A and 3B display an embodiment of the disclosed garment 100'. In the depicted embodiment, the garment 100' is an A-shirt. The garment 100' does not include sleeve portions (120*a,b* in FIGS. 1A and 1B) but does include sleeve openings (shown as 420*a,b* in FIG. 4), wherein the sleeve openings (shown as 420*a,b* in FIG. 4) are defined in the body portion 110. Some features of the garment 100' differ from the garment 100 of FIGS. 1A and 1B. For example, the configuration of the garment 100' creates new lengths and shapes of a top end 112', a left side end 116', a right side end 118', a front portion 144', and a back portion 146', which are all features of a body portion 110'. Moreover, the garment 100' includes a slightly different neck opening 130', although the garment 100' can be configured in crew-neck 135*a'* style as seen in FIG. 3A or in V-neck 135*b'* style as seen in FIG. 3B. However, the bottom end 114, the notch 150, and features thereof do not change on the A-shirt version of the garment 100'. The embodiment depicts but one example variation of the garment 100 of FIGS. 1A and 1B among many possible embodiments. In other embodiments, the garment 100 may be produced as a sleeveless T-shirt, among other possible styles.

Figure 4:
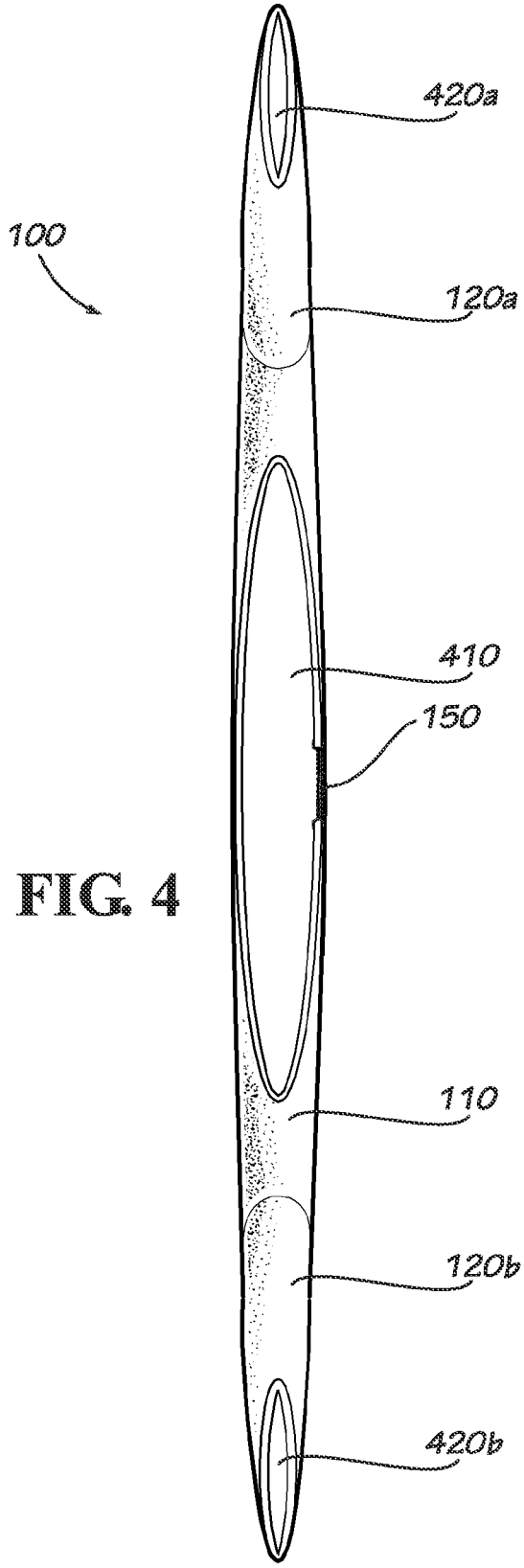
FIG. 4 is a bottom view of a garment in accord with one embodiment of the disclosure.

FIG. 4 shows a bottom view of the garment 100. The body opening 410 is shown defined at the bottom end 114 of the body portion 110. The sleeve openings 420*a,b* are defined in the sleeve portions 120*a,b*.

As shown and described, the notch 150 provides the stay-tuck features of the extra-length shirt without bunching and interference. Moreover, the notch 150 allows the benefits of the taper region 180 without the rolling or creeping up that would normally be experienced by the wearer of a shirt with a smaller bottom width dimension 176 than chest width dimension 174. Also, the shape of the notch 150 allows for the benefits of a notch 150 while reducing the likelihood that the notch 150 would become entangled with other clothing features commonly present in the pelvic region. The serge-stitched edges 152,154,156 of the notch 150 further prevent bunching in the pelvic region.

It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while alternative embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

The invention claimed is:

1. A garment comprising:

a tubular body portion having a top end and a bottom end, the garment defining a body opening proximate the bottom end, a neck opening proximate the top end, and at least two sleeve openings proximate the top end;

wherein the bottom end of the tubular body portion defines a notch, the notch having a terminal edge and two opposing side edges of about equal length, wherein a linear distance separates the opposing side edges, the linear distance being substantially consistent along the about equal length thereby defining substantially parallel opposing side edges.

2. The garment of claim 1, wherein the entire terminal edge is substantially rounded.

3. The garment of claim 1, wherein the entire terminal edge forms one semi-circle and the linear distance is consistent along the about equal length thereby defining parallel opposing side edges.

4. The garment of claim 1, wherein the terminal edge and the opposing side edges comprise overlock stitching.

5. The garment of claim 1, wherein the terminal edge and the opposing side edges are serge stitched.

6. The garment of claim 1, wherein the terminal edge and the opposing side edges are not folded.

7. The garment of claim 1, wherein at least a portion of the body portion is a taper region.

8. A garment comprising:

a shirt, the shirt including a front, a back, and a bottom end;

wherein the front of the shirt defines a notch proximate the bottom end, the notch having a substantially rounded terminal edge; and wherein the entire terminal edge is substantially semi-circular.

9. The garment of claim 8, wherein the notch includes two opposing side edges.

10. The garment of claim 9, wherein the terminal edge and the opposing side edges are overlock stitched.

11. The garment of claim 9, wherein the terminal edge and the opposing side edges are serge stitched.

12. The garment of claim 9, wherein the terminal edge and the opposing side edges are not folded.

13. The garment of claim 8, wherein the body portion is formed from at least two garment pieces, the at least two garment pieces connected with overlock stitching.

14. The garment of claim 8, wherein the garment is made of cotton and up to about five percent spandex.

15. The garment of claim 8, wherein at least a portion of the garment is a taper region.

16. A garment comprising:

a body portion, the body portion including a front, a top end, a bottom end, and at least two sleeve openings, the body portion defining a notch in the front proximate the bottom end, the body portion defining a taper;

wherein the taper is consistently reduced in width from the top end of the body portion to the bottom end of the body portion.

17. The garment of claim 16, wherein the notch includes a terminal edge and two opposing side edges.

18. The garment of claim 17, wherein the terminal edge and the opposing side edges are serge stitched.

19. The garment of claim 17, wherein the terminal edge and the opposing side edges are not folded.

20. The garment of claim 16, further comprising overlock stitching.

21. A garment comprising:

a body portion, the body portion including a front, a back, a top end, a bottom end, an inner surface, an outer surface, and two opposing lateral extents, the body portion defining a body opening at the bottom end, a neck opening at the top end, and at least two sleeve openings proximate the top end;

the body portion defining a notch in the front, the notch defined by at least one edge, the at least one edge connected to the bottom end;

wherein a bottom end distance exists between the two lateral extents at the bottom end and a second distance exists between the two lateral extents proximate the at least two sleeve openings, the second distance being greater than the first bottom end distance; and wherein the body portion defines a consistently-reducing distance between the two opposing lateral extents such that the two opposing lateral extents define a taper, the taper reducing consistently from the second distance to the bottom end distance.

22. The garment of claim 21, wherein the notch includes at least a terminal edge and two opposing side edges.

23. The garment of claim 22, wherein the terminal edge and the opposing side edges are serge stitched.

24. The garment of claim 22, wherein the terminal edge and the opposing side edges are not folded.

* * * * *